US008091901B2

(12) United States Patent
Haskell

(10) Patent No.: US 8,091,901 B2
(45) Date of Patent: Jan. 10, 2012

(54) INTERLOCKING SHOE STRUCTURE

(76) Inventor: Ronald L. Haskell, San Marcos, CA (US)

( * ) Notice: Subject to any disclaimer, the term of this patent is extended or adjusted under 35 U.S.C. 154(b) by 542 days.

(21) Appl. No.: 12/205,781

(22) Filed: Sep. 5, 2008

(65) Prior Publication Data

US 2010/0059957 A1 Mar. 11, 2010

(51) Int. Cl.
*A63C 9/00* (2006.01)
*B62M 1/00* (2010.01)
*A43B 5/00* (2006.01)

(52) U.S. Cl. ..... 280/11.3; 280/87.042; 36/132; 36/136

(58) Field of Classification Search ..... 280/11.3, 280/11.31, 611, 613, 614, 615, 616, 617, 280/618, 620, 623, 624, 625, 633, 635, 87.042; 36/1, 132, 136, 112
See application file for complete search history.

(56) References Cited

U.S. PATENT DOCUMENTS

| | | | | |
|---|---|---|---|---|
| 4,108,452 | A | 8/1978 | Baron | |
| 5,505,477 | A | 4/1996 | Turner et al. | |
| 5,520,405 | A | 5/1996 | Bourke | |
| 5,544,919 | A | 8/1996 | Tinkler | |
| 5,580,077 | A | 12/1996 | Dodge | |
| 5,641,172 | A | 6/1997 | Hoffman et al. | |
| 5,690,350 | A | 11/1997 | Turner et al. | |
| 5,732,959 | A * | 3/1998 | Soejima | 280/14.24 |
| 5,755,046 | A | 5/1998 | Dodge | |
| 5,802,741 | A | 9/1998 | Turner et al. | |
| 5,915,720 | A | 6/1999 | Turner et al. | |
| 5,941,555 | A | 8/1999 | Dodge | |
| 6,050,005 | A | 4/2000 | Dodge | |
| 6,168,173 | B1 | 1/2001 | Reuss et al. | |
| 6,168,183 | B1 | 1/2001 | Turner et al. | |
| 6,267,391 | B1 | 7/2001 | Dodge | |
| 6,270,109 | B1 | 8/2001 | Turner et al. | |
| 6,299,192 | B1 | 10/2001 | Bryce | |
| 6,331,007 | B1 | 12/2001 | Bryce | |
| 6,450,525 | B2 | 9/2002 | Reuss et al. | |
| 6,488,294 | B2 | 12/2002 | Lumb | |
| 6,499,757 | B1 | 12/2002 | Berger et al. | |
| 6,684,534 | B2 | 2/2004 | Dodge | |
| 6,742,801 | B1 | 6/2004 | Dodge | |
| 6,855,023 | B2 | 2/2005 | Berger et al. | |

(Continued)

FOREIGN PATENT DOCUMENTS

FR 2 846 889 A 5/2004

(Continued)

OTHER PUBLICATIONS

International Search Report and Written Opinion of the International Searching Authority for PCT/US2009/054798 mailed Dec. 4, 2009.

*Primary Examiner* — John R Olszewski
(74) *Attorney, Agent, or Firm* — Knobbe Martens Olson & Bear LLP

(57) ABSTRACT

A system for attaching a shoe to a skateboard is described. An interlocking structure attached to the shoe substantially prevents vertical and/or lateral movement of the shoe in relation the skateboard when the interlocking structure is pressed against another interlocking structure. The interlocking structures may register in a plurality of vertical and/or lateral positions. One or both of the interlocking structures may comprise a plurality of protrusions of a pointed or rounded shape.

18 Claims, 9 Drawing Sheets

U.S. PATENT DOCUMENTS

| | | | | |
|---|---|---|---|---|
| 7,047,673 | B2 | 5/2006 | Dodge | |
| 7,469,911 | B2 * | 12/2008 | Sanders | 280/14.24 |
| 7,490,859 | B2 * | 2/2009 | Coing | 280/817 |
| 7,837,219 | B1 * | 11/2010 | Cordes | 280/618 |
| 2002/0140195 | A1 | 10/2002 | Lumb | |
| 2003/0046829 | A1 | 3/2003 | Baechtold | |
| 2003/0075890 | A1 | 4/2003 | Jacobs | |
| 2003/0094788 | A1 | 5/2003 | Jacobs | |
| 2004/0104551 | A1 | 6/2004 | Jacobs | |
| 2004/0155433 | A1 * | 8/2004 | Sanders | 280/624 |

FOREIGN PATENT DOCUMENTS

| | | | |
|---|---|---|---|
| WO | WO 97/48301 | A | 12/1997 |
| WO | WO 2004/062750 | A1 | 7/2004 |

* cited by examiner

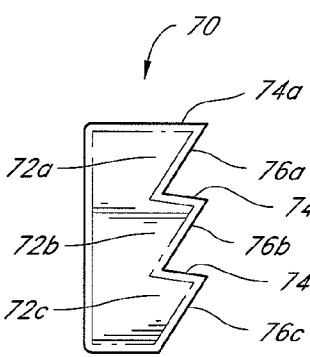
FIG. 5
FIG. 6
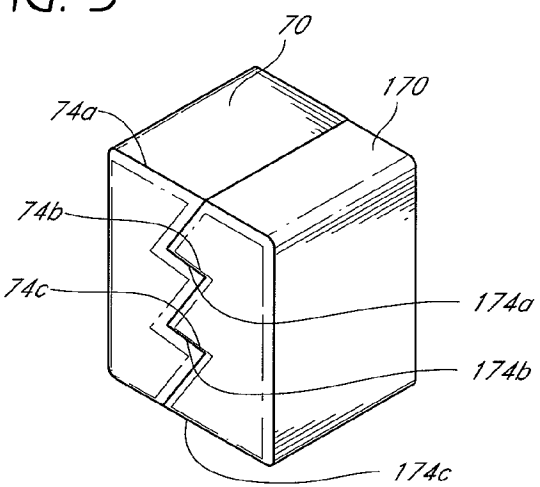
FIG. 7
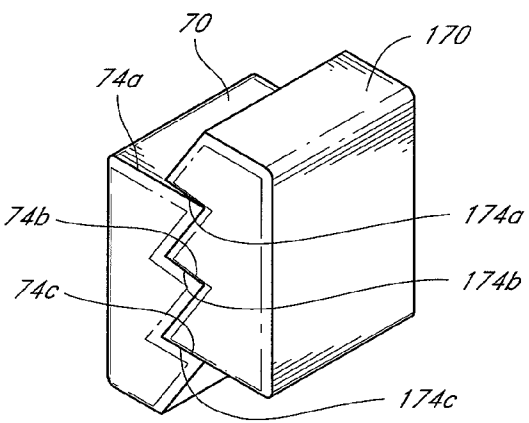
FIG. 8

INTERLOCKING SHOE STRUCTURE

BACKGROUND

1. Field of the Invention

Embodiments of the present invention relate to a system for attaching a shoe to a skateboard to inhibit lateral and/or vertical movement of the shoe in relation to the skateboard.

2. Description of Related Art

Skateboards provide a surface for a user to stand on and wheels that enable the skateboard and user to roll along a surface. While many users enjoy simply standing on the skateboard while it rolls along a surface or prefer to use the skateboard as a means for transportation, some users would rather use the skateboard to perform complicated stunts or tricks. Such stunts or tricks may involve causing the skateboard to lift from the ground or rapidly changing the positioning or direction of the skateboard.

Users typically control the skateboard using friction created between the skateboard and shoes that the user is wearing. Such friction may be increased by coating the surface of the skateboard with a tape or other material that induces high amounts of friction. Even so, a user may find it difficult to control the skateboard using friction alone. Not only is it difficult for many beginning users to control the direction towards which the skateboard is rolling while it is on the ground, it is also difficult for advanced users performing stunts or tricks to cause the skateboard to leave the ground and to control the skateboard while it is in the air.

SUMMARY

One embodiment of the present invention thus includes a system for attaching a shoe to a skateboard. The system comprises a shoe comprising a first interlock structure on an outer portion of the shoe; and a skateboard having a top and a bottom and comprising a second interlock structure extending upward from the top of the skateboard, wherein the second interlock structure is configured to substantially prevent vertical or lateral movement of the shoe in relation to the skateboard when the first interlock structure is transversely pressed against the second interlock structure, wherein the first interlock structure and the second interlock structure register in a plurality of lateral or vertical positions, and wherein the first or second interlock structure comprises a plurality of protrusions.

Another embodiment includes an interlocking shoe. The interlocking shoe comprises means for securing the shoe to a foot of a user of the shoe; and a first interlock structure attached to an outer portion of the shoe and comprising a plurality of protrusions, wherein the first interlock structure is configured to substantially prevent vertical or lateral movement of the shoe in relation to a second interlock structure when the first interlock structure is transversely pressed against the second interlock structure, and wherein the first interlock structure and the second interlock structure register in a plurality of lateral or vertical positions.

Yet another embodiment includes an interlocking skateboard. The interlocking skateboard comprises one or more wheels attached to a bottom of the skateboard; and a first interlock structure extending upward from a top of the skateboard and comprising a plurality of protrusions, wherein the first interlock structure is configured to substantially prevent vertical or lateral movement of the skateboard in relation to a second interlock structure when the second interlock structure is transversely pressed against the first interlock structure, and wherein the second interlock structure and the first interlock structure register in a plurality of lateral or vertical positions.

Further aspects, features and advantages of the present invention will become apparent from the detailed description of certain embodiments that follows.

BRIEF DESCRIPTION OF THE DRAWINGS

The above mentioned and other features of the invention will now be described with reference to the drawings of several embodiments of the present system for attaching a shoe to a skateboard. The illustrated embodiments of the system are intended to illustrate, but not to limit the invention. The drawings contain the following figures:

FIG. 5 is a perspective view of a first embodiment of an interlock structure of FIG. 1A.

FIG. 6 is a side view of a first embodiment of an interlock structure of FIG. 1A.

FIG. 7 is a perspective view of a first embodiment of an interlock structure, illustrated in FIG. 5, pressed against an embodiment of an interlock structure complementary to the first embodiment.

FIG. 8 is another perspective view of a first embodiment of an interlock structure, illustrated in FIG. 5, pressed against an embodiment of an interlock structure complementary to the first embodiment.

DETAILED DESCRIPTION OF CERTAIN EMBODIMENTS

Figure 1A:
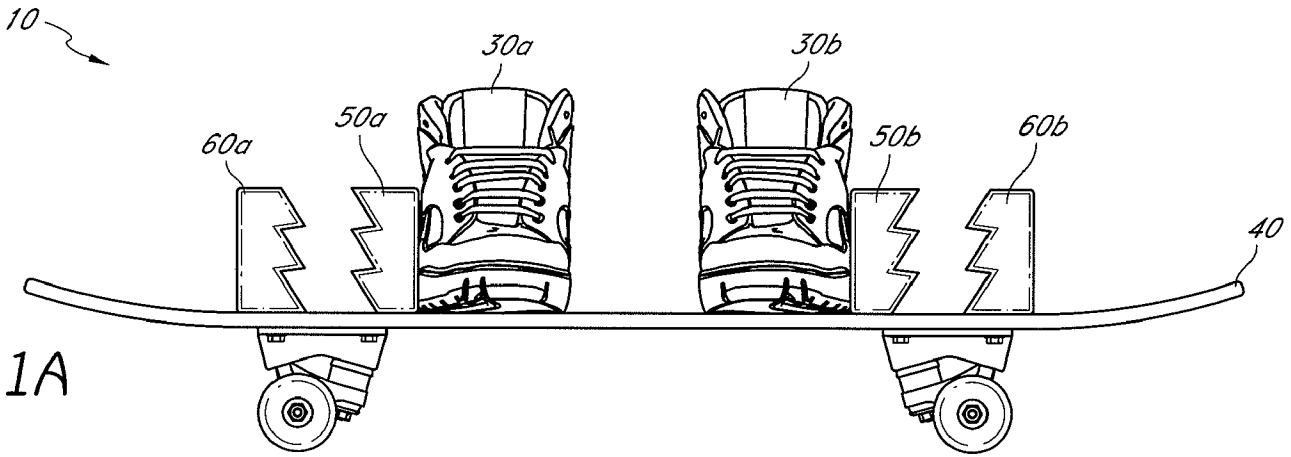
FIG. 1A is a side view of a system for attaching a shoe to a skateboard.

The present embodiments of a system for attaching a shoe to a skateboard may be utilized with a variety of types of sports equipment. It will be understood by one of skill in this art, in light of the present disclosure, that the system disclosed herein can be successfully utilized in connection with types of sports equipment that include binding or attaching a shoe or boot to a board. For example, but without limitation, the system disclosed herein can be configured to attach a shoe or a boot to a skateboard, a snowboard, and/or a wakeboard. One skilled in the art can also find additional applications for the apparatuses and systems disclosed herein. Thus, the illustrations and descriptions of the system for attaching a shoe to a skateboard are merely exemplary of one possible application of the system.

The system for attaching a shoe to a skateboard described herein is especially adapted to arrest vertical and/or lateral movement of the shoe in relation to the skateboard. Thus, a user wearing the shoe can substantially control operation of the skateboard. When the user raises the shoe, the skateboard will raise with the shoe, enabling the user to lift the skateboard into the air. While the board is raised from the ground, the user may lower the shoe, thereby causing the skateboard to lower back towards the ground. Regardless of whether the skateboard is on the ground or raised from the ground, it may be possible for the user to cause the skateboard to move in a lateral direction by shifting the shoe in a lateral direction.

The system arrests lateral and/or vertical movement when at least two interlocking structures are transversely pressed together, wherein one interlocking structure is attached to the shoe and the other interlocking structure is attached to the skateboard. In the illustrated embodiments, described in more detail below, the user may press the interlocking structures together in a plurality of vertical and/or lateral positions. Thus, the user is not confined to a single interlocking configuration, but may press the interlocking structures together as convenient or necessary. Additionally, the interlocking structures do not require the user to place the shoe underneath another structure, which may limit the user's freedom of movement, but rather that the user transversely push or pull one of the interlocking structures, attached to the shoe, against the other one of the interlocking structures, attached to the skateboard. Unlike bindings or clips, the engagement systems disclosed herein hold the shoe to the skateboard as long as they are pressed together by the user's feet, and instantly release when the user moves his or her feet away. Engagement and disengagement can be done by simple lateral movement of the feet, and because some embodiments permit the structures to engage in multiple positions, the system does not require the precision of foot placement necessary to engage a binding or clip. This makes it more amenable for use in a high speed action sport such as skateboarding, where engagement and disengagement can be desirable in a fraction of a second. Also, because engagement is maintained only so long as the user is affirmatively applying pressure to the interlocking structure, the danger of injury due to nonrelease between the board and the user's foot is small to none.

FIG. 1A is a side view of the system 10 for attaching a shoe 30 to a skateboard 40. The system 10 comprises shoes 30*a* and 30*b;* a skateboard 40; first interlock structures 50*a* and 50*b* attached to the shoes 30*a* and 30*b*, respectively; and second interlock structures 60*a* and 60*b* attached to the skateboard 40. The first interlock structures 50*a* and 50*b* may be pressed against and interact with the second interlock structures 60*a* and 60*b*.

The system 10 is illustrated with the first interlock structures 50*a* and 50*b* separated from the second interlock structures 60*a* and 60*b*. In this configuration, a user of the system 10 may operate the skateboard 40 in the usual manner. It is possible for the user to shift one or both of the shoes 30*a* and 30*b* laterally, transversely, or vertically without affecting the positioning of the skateboard 40, or the user may use friction between the shoes 30*a* and/or 30*b* and the skateboard 40 to alter the positioning of the skateboard 40. In addition, the user may readily remove one or both of the shoes 30*a* and 30*b* from the skateboard 40, such as when the user wishes to carry the skateboard 40 instead of riding it or when the user wishes to dismount from the skateboard 40, such as during the execution of a trick which the user foresees as having a negative outcome.

The size of the interlock structures 50*a*, 50*b*, 60*a*, and 60*b* relative to the shoes 30*a* and 30*b* and the skateboard 40 is illustrative only. The interlock structures 50*a,* 50*b*, 60*a*, and 60*b* may be larger or smaller relative to the size of the shoes 30*a* and 30*b*, or the interlock structures 50*a*, 50*b*, 60*a*, and 60*b* may be larger or smaller relative to the size of the skateboard 40. In addition, the interlock structures 50*a*, 50*b*, 60*a*, and 60*b* may vary in size relative to each other.

Figure 1B:
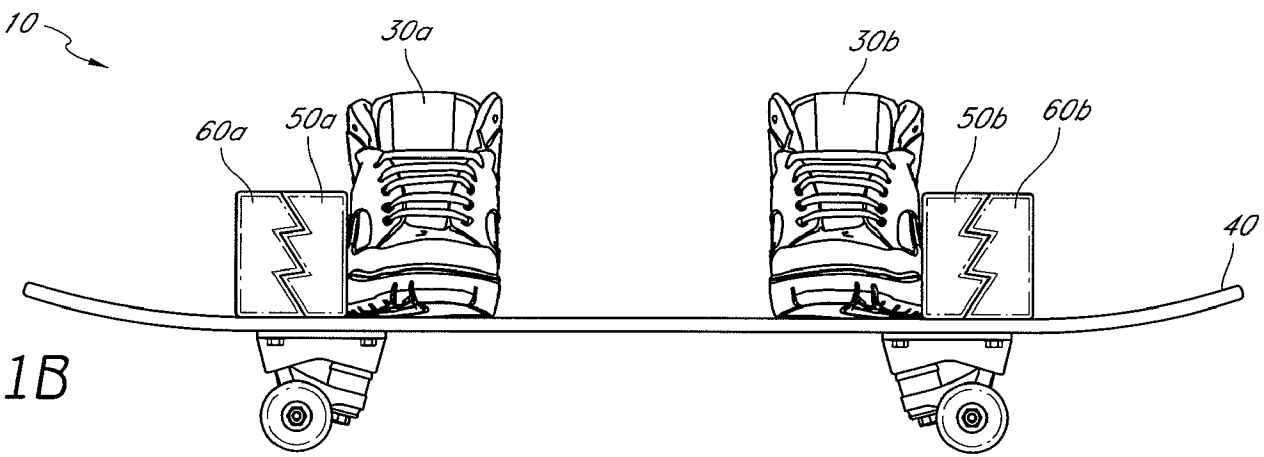
FIG. 1B is another side view of the system for attaching a shoe to a skateboard of FIG. 1A.

FIG. 1B is another side view of the system 10, illustrated in FIG. 1A, for attaching the shoe 30 to the skateboard 40. In FIG. 1B, the system 10 is illustrated with the first interlock structures 50*a* and 50*b* transversely pressed against the second interlock structures 60*a* and 60*b*, respectively. To accomplish this, the user of the system 10 shifts one or both shoes 30*a* and/or 30*b* towards the second interlock structures 60*a* and/or 60*b,* respectively, until the first interlock structures 50*a* and/or 50*b* contact the second interlock structures 60*a* and/or 60*b*, respectively. In the illustrated embodiment, both shoes 30*a* and 30*b* are shifted towards the ends of the skateboard 40 in order to contact the second interlock structures 60*a* and 60*b*. As can be seen in FIG. 1B, when the first interlock structures 50*a* and 50*b* are pressed against the second interlock structures 60*a* and 60*b*, a portion of the interlock structures 50*a* and 50*b* overlaps with a portion of the interlock structures 60*a* and 60*b*, respectively. This interaction is described in more detail below.

Figure 2A:
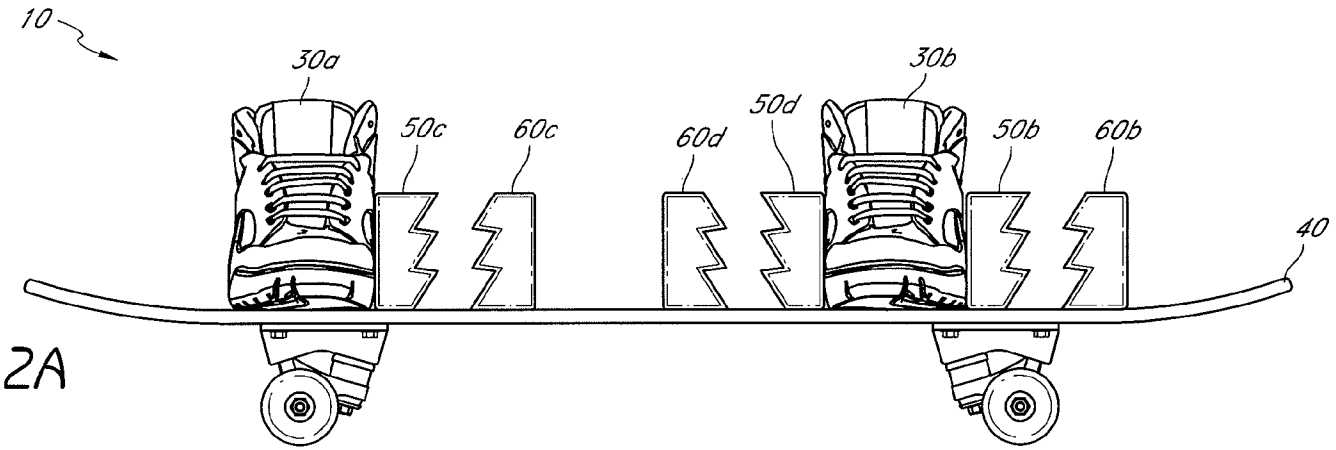
FIG. 2A is a side view of another embodiment of a system for attaching a shoe to a skateboard.

FIG. 2A is a side view of another embodiment of the system 10 for attaching the shoe 30 to the skateboard 40. In FIG. 2A, the interlock structures 50*a* and 60*a* of FIG. 1A, located distal to the shoe 30*a*, have been replaced by a first interlock structure 50*c* and a second interlock structure 60*c*, respectively, located proximal to the shoe 30*a*. In addition, the system 10 additionally includes a first interlock structure 50*d* and a second interlock structure 60*d* located proximal the shoe 30*b*. In other words, the interlock structures 50*c* and 50*d* on the skateboard 40 are now located between the shoes 30*a* and 30*b*, such that they can be engaged by moving the feet together to engage the interlock structures. This can be instead of or in addition to interlock structures on the skateboard 40 located outside of the shoes 30*a* and 30*b*.

Figure 2B:
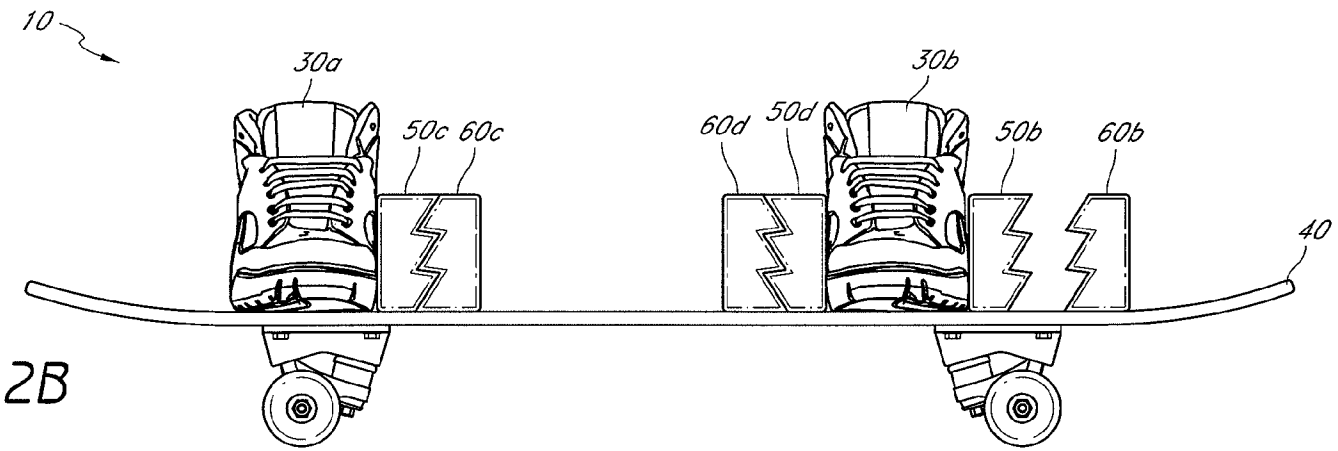
FIG. 2B is another side view of the system for attaching a shoe to a skateboard of FIG. 2A.

FIG. 2B is another side view of the system 10, illustrated in FIG. 2A, for attaching the shoe 30 to the skateboard 40. In FIG. 2B, the system 10 is illustrated with the first interlock structures 50*c* and 50*d* transversely pressed against the second interlock structures 60*c* and 60*d*, respectively. In the illustrated embodiment, both shoes 30*a* and 30*b* are shifted towards the center of the skateboard 40 in order to contact the second interlock structures 60*c* and 60*d*.

Figure 2C:
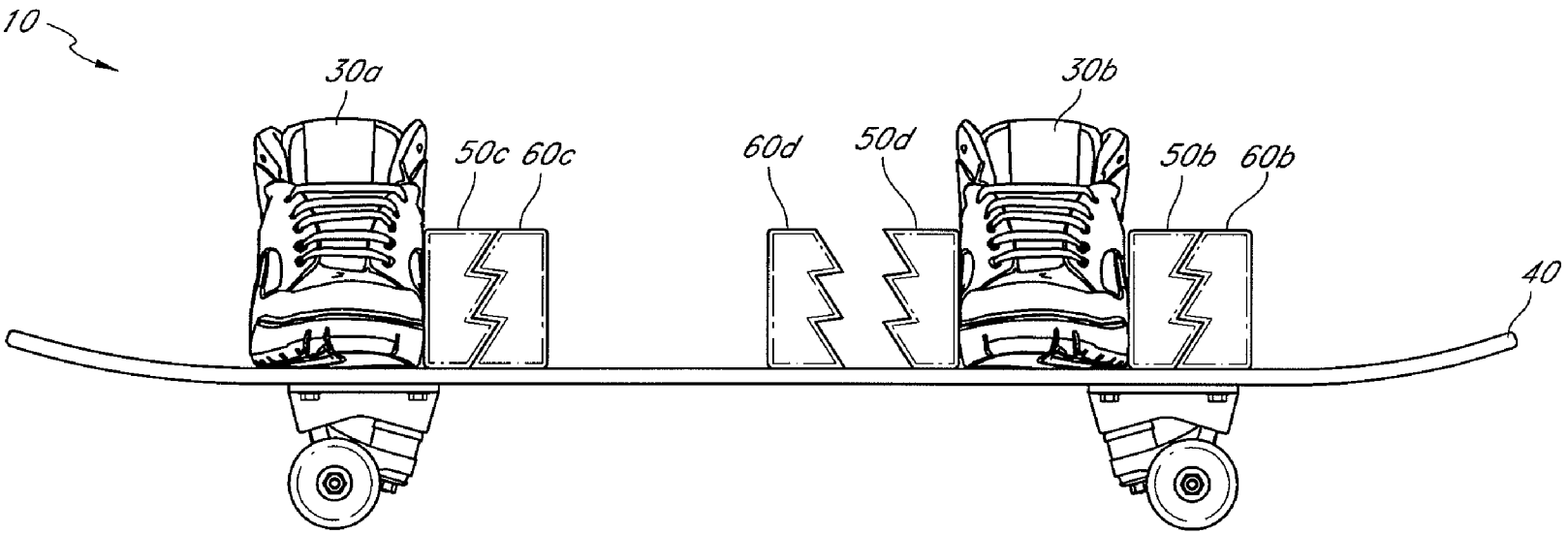
FIG. 2C is another side view of the system for attaching a shoe to a skateboard of FIG. 2A.

FIG. 2C is another side view of the system 10, illustrated in FIG. 2A, for attaching the shoe 30 to the skateboard 40. In FIG. 2C, the system 10 is illustrated with the first interlock structures 50*c* and 50*b* transversely pressed against the second interlock structures 60*c* and 60*b*, respectively. In the illustrated embodiment, the shoe 30*a* is shifted towards the center of the skateboard 40 in order to contact the first interlock structure 60*c*, and the shoe 30*b* is shifted towards the end of the skateboard 40 in order to contact the second interlock structure 60*b*.

As can be seen in FIGS. 2B and 2C, the shoe 30*b* may be shifted in a plurality of directions in order to contact one of the second interlock structures 60*b* or 60*d*. Alternatively or in addition to this configuration, the system 10 may be configured such that the shoe 30*a* may be shifted in a plurality of directions in order to contact a second interlock structure. In some embodiments, the second interlock structures 60*c* and 60*d* may be combined such that a first interlock structure can engage the combined second interlock structure from either side. Such configuration will be described in more detail below. Those of skill in the art will appreciate that interlock structures may be disposed either proximal or distal, or both proximal and distal, to each shoe 30*a* or 30*b*.

Figure 3:
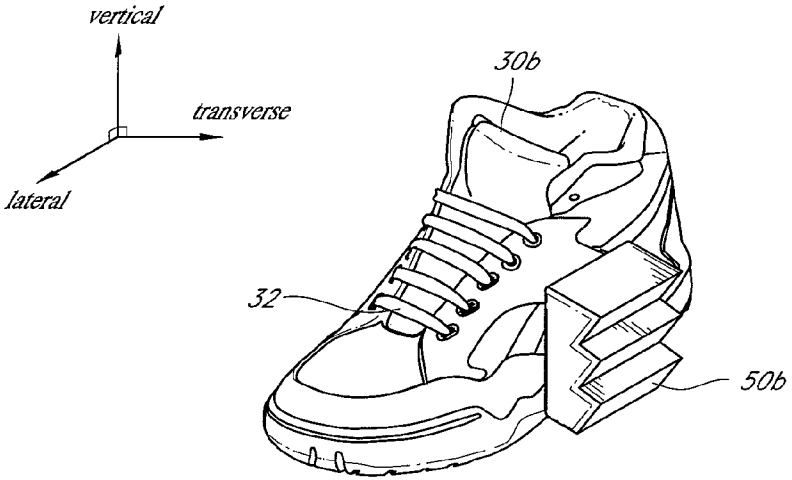
FIG. 3 is a perspective view of the shoe and first interlock structure of FIG. 1A.

FIG. 3 is a perspective view of the shoe 30*b* and the first interlock structure 50*b* of FIG. 1A. The first interlock 50*b* is attached to an outer surface of the shoe 30*b*. One of skill in the art will understand that the descriptions of the shoe 30*b*, the first interlock structure 50*b*, and the interactions between the first interlock structure 50*b* and second interlock structure 60*b* are equally descriptive of the shoe 30*a*, the first interlock structure 50*a*, and the interactions between the first interlock structure 50*a* and second interlock structure 60*a*.

In the illustrated embodiment, the shoe 30*b* has laces 32 to aid in securing the shoe 30*b* to the user's foot. One skilled in the art will understand that the shoe 30*b* may comprise means for securing the shoe to the user's foot other than or in addition to the laces 32. For example, but without limitation, the shoe 30*b* may comprise straps, bands, buckles, elastic cords, or an expanse of material configured to secure the shoe 30*b* to the user's foot.

To assist in the description of the components of embodiments of the shoe 30*b* and the first interlock structure 50*b*, the following coordinate terms are used, consistent with the coordinate axes illustrated in FIG. 3. A "vertical axis" is generally normal to a sole of the shoe 30*b*. Similarly, when discussing only the first interlock structure 50*b* independently of the shoe 30*b*, the "vertical axis" is generally normal to a bottom of the interlock structure. A "lateral axis" is generally parallel to the first interlock structure 50*b*, thus running from the toe of the shoe 50*b* to the heel of the shoe 50*b*. Similarly, when discussing only the first interlock structure 50*b* independently of the shoe 30*b*, the "lateral axis" is generally parallel to the first interlock structure 50*b* and normal to the vertical axis. A "transverse axis" extends normal to both the vertical and lateral axes, thus being generally normal to the first interlock structure 50*b*. In addition, as used herein, "the longitudinal direction" refers to a direction substantially parallel to the longitudinal axis; "the lateral direction" refers to a direction substantially parallel to the lateral axis; and "the transverse direction" refers to a direction substantially parallel to the transverse axis. Also, the terms "proximal" and "distal" are used consistently within the description. Thus, proximal and distal are used in reference to the midline of a user's body.

In the illustrated embodiment, the first interlock structure 50*b* is distally attached to an outer surface of the shoe 30*b*. Such placement of the first interlock structure 50*b* allows the user to shift the shoe 30*b* and the first interlock structure 30*b* towards an end of the skateboard 40 to engage the first interlock structure 50*b* with the second interlock structure 60*b*. In another embodiment, the first interlock structure 50*b* may be proximally attached to an outer surface of the shoe 30*b*, allowing the user to shift the shoe 30*b* and the first interlock structure 50*b* towards the center of the skateboard 40 to engage the first interlock structure 50*b* with the second interlock structure 60*b*. Such configuration is illustrated in FIG. 2A with respect to the shoe 30*a* and the interlock structures 50*c* and 60*c*.

In yet another embodiment, a plurality of interlock structures may be attached to the shoe 30*b* such that there is at least one interlock structure proximally attached and at least one interlock structure distally attached. This configuration is illustrated in FIG. 2A with respect to the shoe 30*b* and the first interlock structures 50*b* and 50*d*. The plurality of interlock structures may be substantially identical or may differ in form and shape.

In the illustrated embodiment, the first interlock structure 50*b* is approximately laterally centered along the shoe 50*b* and spans only a portion of the lateral length of the shoe 30*b*. Such centering may increase the user's control of the skateboard 40. The user can push up or pull down with the toe and/or heel of the shoe 30*b* to operate the system, as opposed to only being able to use the toe or heel area of the shoe 30*b* for control. Additionally, locating the first interlock structure 50*b* at a lateral center of the shoe 30*b* may decrease a foot fatigue that the user experiences after lengthy operation. In another embodiment, the first interlock structure 50*b* may be located at a different lateral location along the shoe 30*b* or the first interlock structure may span approximately the entire lateral length of the shoe 30*b*. In yet another embodiment, a plurality of interlock structures may be attached along the lateral length of the shoe 30*b*. The plurality of interlock structures may be substantially identical or may differ in form and shape.

In the illustrated embodiment, the bottom of the first interlock structure 50*b* is aligned with the bottom of the shoe 30*b*, but does not extend to the top of the shoe 30*b*. Such configuration may ensure that the user is able to engage the first interlock structure 50*b* with the second interlock structure 60*b* at a point vertically proximate to the skateboard 40. Engaging the first interlock structure 50*b* with the second interlock structure 60*b* in this way may increase user control of the skateboard 40 and response of the skateboard 40 to the user's movements. In another embodiment, the first interlock structure 50*b* may be positioned so that it is not aligned with the bottom of the shoe 30*b*. For example, the first interlock structure 50*b* may be angled with respect to the bottom of the shoe 30*b*, may be located higher up on the shoe 30*b*, or may span approximately the entire vertical height of the shoe 30*b*. In yet another embodiment, a plurality of interlocks structure may be attached along the vertical height of the shoe 30*b*.

The first interlock structure 50*b* may be permanently attached to the shoe 30*b* or releasably attached to the shoe 30*b*. For example, the first interlock structure 50*b* may be permanently bonded to the shoe 30*b*, such as by use of a permanent adhesive, by sewing, or by forming the first interlock structure to be integral with a portion of the shoe 30*b*.

The first interlock structure 50*b* may also be releasably attached to the shoe 30*b*, such as by use of complementary hook and loop areas disposed on the first interlock structure 50*b* and the shoe 30*b*. When pressed together, the complementary hook and loop areas attach, thereby securing the first interlock structure 50*b* to the shoe 30*b* in a configuration substantially similar to the configuration illustrated in FIG. 3.

The embodiments described above may be selected at manufacturing. For example, a manufacturer of the system 10 of FIG. 1A may attach the first interlock structure 50*b* to the shoe 30*b* in a specific position, or the manufacturer may produce several models of the system 10 in which the first interlock structure 50*b* is attached to different locations along the shoe 30*b*. Placement of the first interlock structure 50*b* can be accomplished by permanently attaching the first interlock structure 50*b* at a predetermined location along the shoe 30*b*, or by placing a hook or loop area at a predetermined location along the shoe 30*b* for the first interlock structure 50*b* to attach to, for example.

Alternatively, the user may be able to select the positioning of the first interlock structure 50*b* along the shoe 30*b*. The user may be provided with the first interlock structure 50*b* and an adhesive to attach the first interlock structure 50*b* to a shoe belonging to the user or to a provided shoe. In the case of the first interlock structure 50*b* being capable of releasably attaching to the shoe 30*b*, for example by use of complementary hook and loop areas, the user may be able to choose where to place the hook or loop area on a shoe of the user or on a provided shoe, or the user may be able to choose where to contact the first interlock structure 50*b* to the shoe 30*b* once the hook and loop areas are disposed on the first interlock structure 50*b* and the shoe 30*b*.

Figure 4:
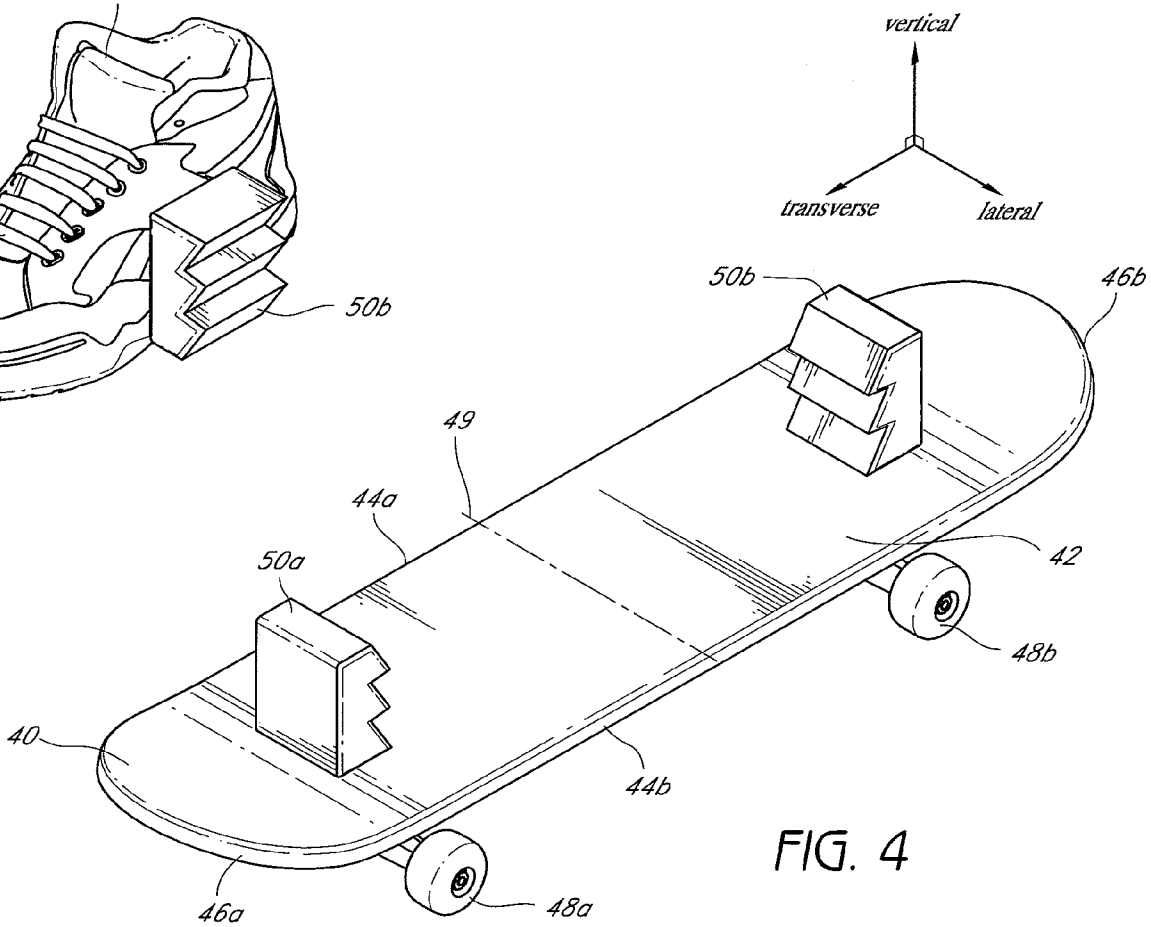
FIG. 4 is a perspective view of the skateboard and second interlock structures of FIG. 1A.

FIG. 4 is a perspective view of the skateboard 40 and the second interlock structures 60*a* and 60*b* of FIG. 1A. Although description will primarily be made to a skateboard having two second interlock structures 60*a* and 60*b* on a top 42 of the skateboard 40, one skilled in the art will understand that only one interlock structure or more than two interlock structures can be attached to the top 42.

To assist in the description of the components of embodiments of the skateboard 40 and the interlocking structures 60*a* and 60*b*, the following coordinate terms are used, consistent with the coordinate axes illustrated in FIG. 4 and the coordinate terms described in reference to FIG. 3. A "vertical axis" is generally normal to the top 42. A "lateral axis" is generally parallel to the top 42, extends between side edges 44*a* and 44*b* of the skateboard 40, and is generally normal to both the vertical axis and a direction in which the skateboard is configured to roll naturally. A "transverse axis" extends normal to both the vertical and lateral axes, thus extending between ends 46*a* and 46*b* of the skateboard 40 and being generally parallel to a direction in which the skateboard is configured to roll naturally.

In the illustrated embodiment, the second interlock structures 60*a* and 60*b* are situated in a generally lateral direction. They are positioned to be substantially perpendicular to the edges 44*a* and 44*b*. Such positioning enables a lateral force applied to the second interlock structure 60*a* or 60*b* to easily change which direction the skateboard 40 is pointed towards. In another embodiment, one or both of the second interlock structures 60*a* and 60*b* may be angled with respect to the edges 44*a* and/or 44*b*. Such embodiment may be useful when the edges 44*a* and 44*b* are not parallel, such as when the edges 44*a* and 44*b* are rounded or taper towards the end 46*a* or 46*b*. This embodiment may also be useful when the user wishes to have the second interlock structures 60*a* and 60*b* positioned differently, such as to conform to a stance of the user when riding the skateboard 40. For example, the user may prefer to angle the toes of one foot away from the toes of the other foot when riding, and thus may prefer to position the second interlock structures 60*a* and 60*b* accordingly.

In the illustrated embodiment, the second interlock structures 60*a* and 60*b* extend upward from the top 42 of the skateboard 40 in a generally vertical direction. Situating the second interlock structures 60*a* and 60*b* in this way enables a vertical force applied to the second interlock structure 60*a* or 60*b* to easily lift or lower the skateboard 40. In another embodiment, one or both of the second interlock structures 60*a* and 60*b* may be angled with respect to the top 42. Such embodiment may accommodate varying shapes of the first interlock structures 50*a* and 50*b* or varying attachment of first interlock structures 50*a* and 50*b* to the shoes 30*a* and 30*b*, respectively. In addition, the second interlock structures 60*a* and 60*b* may be angled according to a skill level of the user of the system 10: more skilled users may desire a more vertical arrangement of the second interlock structures 60*a* and 60*b*, while a less skilled user may desire that the second interlock structures 60*a* and 60*b* be angled such that the second interlock structures 60*a* and 60*b* will largely overlap the first interlock structures 50*a* and 50*b*. Thus, the interlock structures 60*a* and 60*b* may be configured in a variety of positions extending upward from the top 42.

In the illustrated embodiment, the skateboard 40 and the second interlock structures 60*a* and 60*b* are configured to be symmetric about a center line 49. Using this configuration, the user may be able to the system 10 regardless of which direction the user is facing. In other embodiments, the skateboard 40 may not be symmetric. For example, the second interlock structures 60*a* and 60*b* may be embodied as different shapes, as opposed to similar shapes as illustrated in FIG. 4. The second interlock structures 60*a* and 60*b* may also be similar shapes, but situated in different directions. Depending on the configuration of the first interlock structures 50*a* and/or 50*b* attached to the shoes 30*a* and/or 30*b*, the first interlock structures 50*a* and 50*b* may only be able to interact with the second interlock structures 60*a* and 60*b* when the user is practicing a particular stance or facing a particular direction. Differing configurations may result in the board being "directional," i.e. configured to roll in a predetermined direction.

In the illustrated embodiment, the second interlock structure 60*a* is positioned to engage the first interlock structure 50*a* when the first interlock structure 50*a* is shifted towards the end 46*a* of the skateboard 40, as described in FIG. 1B. Similarly, the second interlock structure 60*b* is positioned to engage the first interlock structure 50*b* when the first interlock structure 50*b* is shifted towards the end 46*b* of the skateboard 40, also as described in FIG. 1B. In other embodiments, either or both of the second interlock structures 60*a* and 60*b* may be positioned to engage the first interlock structures 50*a* and 50*b*, respectively, when the first interlock structures 50*a* and 50*b* are shifted towards the center line 49, such as illustrated in FIG. 2B.

The second interlock structures 60*a* and 60*b* may be permanently attached to the skateboard 40 or releasably attached to the skateboard 40. The second interlock structures 60*a* and 60*b* may be attached by using an adhesive, by forming the second interlock structures 60*a* and 60*b* integral to the skateboard 40, or by using a hook and loop attachment, all of which are described above in relation to attaching the first interlock structure 50*b* to the shoe 50*b*. The second interlock structures 60*a* and 60*b* may also be attached using means such as threaded or self-locking fasteners, for example screws, whereby it may be possible to adjust the positioning of the second interlock structures 60*a* and 60*b* on the skateboard 40 by removing and relocating the fasteners.

Although the illustrated embodiment is a skateboard 40 having four wheels (wheels 48*a* and 48*b*, and two wheels that aren't shown) arranged in a square or rectangular pattern and attached to a bottom of the skateboard 40 (not shown), the system 10 may be implemented using other configurations or types of boards. For example, the skateboard 40 may have more or less than four wheels, and the wheels may be arranged in a pattern different than a square or rectangle. Also, other types of board may be used, such as snowboards or wakeboards, which do not have any wheels.

Embodiments of an interlock structure of FIG. 1A will now be described. The following descriptions of an interlock structure may apply to any one of interlock structures 50*a*, 50*b*, 60*a*, and 60*b*. The interlock structure may comprise a variety of materials. In one embodiment, the interlock structure is a resilient material. An interlock structure comprising a resilient material may flex when pressure is placed on the interlock structure, which decreases the likelihood that a user will be injured by falling on the interlock structure. Such resilient material may comprise a polymer, such as rubber or polyurethane, and may be a solid, porous, or foam material. Materials such as polymers may produce a large amount of friction when pushed together; thus, a user pushing two interlock structures made of polymers together may experience increased control of the system 10.

FIG. 5 is a perspective view of a first embodiment of an interlock structure 70 of FIG. 1A. The interlock structure 70 is comprised of pointed shapes 72*a*, 72*b*, and 72*c*. The pointed shapes 72*a*, 72*b*, and 72*c* are illustrated as being arranged in a series of rows. The rows are illustrated as being substantially lateral, but may be angled from a lateral direction. Although three rows of the pointed shapes 72*a*, 72*b*, and 72*c* are illustrated, the interlock structure 70 may comprise additional pointed shapes and rows of pointed shapes. The pointed shapes 72*a*, 72*b*, and 72*c* may be disposed on one or more sides of the interlock structure 70. In the illustrated embodiment, the pointed shapes 72*a*, 72*b*, and 72*c* are protrusions that are substantially triangular and extend laterally across the interlock structure 70. In another embodiment, the pointed shapes 72*a*, 72*b*, and 72*c* may be arranged in a series of columns and may extend vertically across the interlock structure 70.

As can be seen in a side view of the interlock structure 70, illustrated in FIG. 6, each of the pointed shapes 72*a*, 72*b*, and 72*c* comprises an upper surface 74*a*, 74*b*, and 74*c*, respectively. The upper surfaces 74*a*, 74*b*, and 74*c* are configured such that when the interlock structure 70 is raised, the upper surfaces 74*a*, 74*b*, and 74*c* can apply a substantially vertical force. Thus, any structure that overlaps one of the upper surfaces 74*a*, 74*b*, and 74*c* will be pushed upward when the interlock structure 70 is raised.

In the illustrated embodiment, each of the pointed shapes 72*a*, 72*b*, and 72*c* also comprises a lower surface 76*a*, 76*b*, and 76*c*, respectively. The lower surfaces are shown as being substantially linear, but the lower surfaces may also be of a curved, rounded, or wavy shape.

FIG. 7 is a perspective view of the interlock structure 70, illustrated in FIG. 5, pressed against an embodiment of an interlock structure 170 that is complementary to the interlock structure 70. The interlock structure 170 will be described in more detail below.

Movement of either the interlock structure 70 or the interlock structure 170 may cause the other interlock structure to move when the interlock structures 70 and 170 are pressed against each as illustrated. When the interlock structure 70 is raised, the upper surfaces 74*b* and 74*c* can apply a force to lower surfaces 176*a* and 176*b*, respectively, of the pointed shapes 172*a* and 172*b* of the interlock structure 170. Thus, when the interlock structure 70 is raised, the interlock structure 170 will also be raised. Conversely, when the interlock structure 170 is lowered, the lower surfaces 176*a* and 176*b* will apply a force on the upper surfaces 74*b* and 74*c*, respectively, and the interlock structure 70 will also be lowered. If there is sufficient friction between the interlock structures, then lateral movement of either interlock structure 70 or 170 may cause the other interlock structure to move laterally as well.

As can be seen in FIG. 8, the interlock structure 70 and the interlock structure 170 can be pressed together, or register, in positions other than that illustrated in FIG. 7. In the position illustrated in FIG. 8, the upper surface 74*c* may apply a force to the lower surface 176*a* or the lower surface 176*a* may apply a force to the upper surface 74*c*. Alternatively, the upper surfaces 74*a* and 74*b* can contact the lower surfaces 176*a* and 176*b*, respectively, and force can be applied between them. The upper surface 74*a* may also be in contact with the lower surface 176*b* and force can be applied them. Additional positions are possible in the case where the interlock structure 70 or 170 comprises additional pointed shapes. Also, the interlock structure 70 and/or the interlock structure 170 may be laterally positioned, or registered, in any number of ways.

Figure 9:
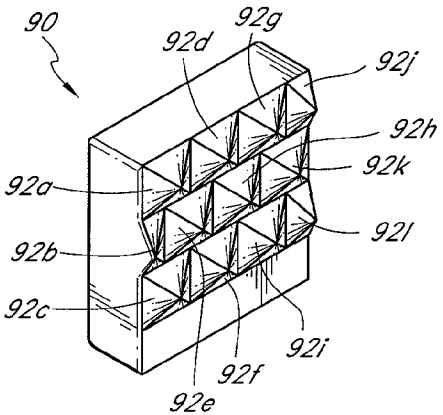
FIG. 9 is a perspective view of a second embodiment of an interlock structure of FIG. 1A.

FIG. 9 is a perspective view of a second embodiment of an interlock structure 90 of FIG. 1A. The interlock structure 90 is comprised of pointed shapes 92*a* through 92*l*. The pointed shapes 92*a* through 92*j* are illustrated as being arranged in a series of rows. The rows are illustrated as being substantially lateral, but may be angled from a lateral direction. Although three rows of the pointed shapes 92*a* through 92*l* are illustrated, the interlock structure 90 may comprise additional pointed shapes and rows of pointed shapes. Each row comprises a plurality of pointed shapes. Although the rows of the pointed shapes 92*a* through 92*l* are illustrated as comprising three or four pointed shapes, the rows may comprise fewer or additional pointed shapes. The pointed shapes 92*a* through 92*l* may be disposed on one or more sides of the interlock structure 90. In the illustrated embodiment, the pointed shapes 92*a* through 92*l* are protrusions that are substantially pyramidal.

Figure 10:
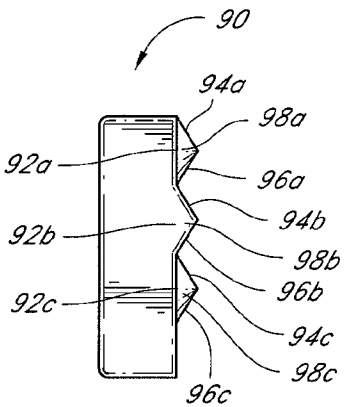
FIG. 10 is a side view of a second embodiment of an interlock structure of FIG. 1A.

As can be seen in a side view of the interlock structure 90, illustrated in FIG. 10, each of the pointed shapes 92*a*, 92*b*, and 92*c* comprises an upper surface 94*a*, 94*b*, and 94*c*, respectively; a lower surface 96*a*, 96*b*, and 96*c*, respectively; a first side surface 98*a*, 98*b*, and 98*c*, respectively; and a second side surface (not show in this view). The upper surfaces 94*a*, 94*b*, and 94*c*, and the lower surfaces 96*a*, 96*b*, and 96*c*, are configured such that when the interlock structure 90 is raised or lowered, either the upper surfaces 94*a*, 94*b*, and 94*c*, or the lower surfaces 96*a*, 96*b*, and 96*c*, can apply a substantially vertical force. Thus, any structure that overlaps one of the upper surfaces 94*a*, 94*b*, and 94*c* will be pushed upward or downward when the interlock structure 90 is raised or lowered. Similarly, the first side surfaces 98*a*, 98*b*, and 98*c*, and the second side surfaces, are configured such that when the interlock structure 90 is moved laterally, the first side surfaces 98*a*, 98*b*, and 98*c*, and the second side surfaces, can apply a substantially lateral force. The pointed shapes 92*d* through 92*l* have similar features, but are not visible in this view.

Figure 11:
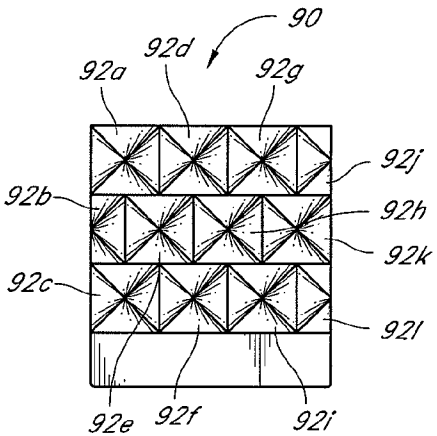
FIG. 11 is a front view of a second embodiment of an interlock structure of FIG. 1A.

As can be seen in a front view of the interlock structure 90, illustrated in FIG. 11, the pointed shapes 92*a* through 92*l* of the illustrated embodiment are arranged in a series of three lateral rows, but the pointed shapes 92*a* through 92*l* are not arranged in columns. The pointed shapes 92*b*, 92*e*, 92*h*, and 92*k* are laterally offset from the other pointed shapes 92*a*, 92*c*, 92*d*, 92*f*, 92*g*, 92*i*, 92*j*, and 92*l*. Thus, a repeating pattern of pointed shapes is formed.

Figure 21:
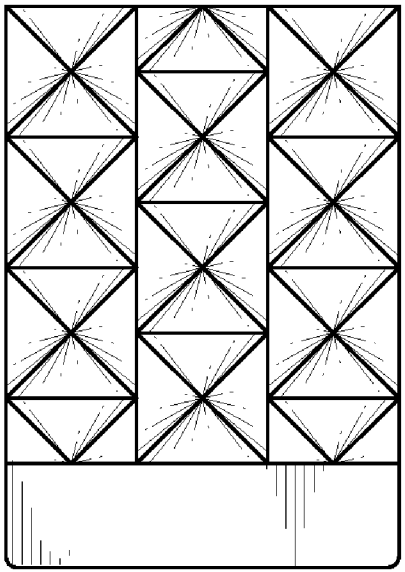
FIG. 21 is a front view of an embodiment of an interlock structure.

In the illustrated embodiment, the apexes of the pointed shapes 92*e*, 92*h*, and 92*k* are approximately vertically aligned with a space where the other pointed shapes 92*a*, 92*c*, 92*d*, 92*f*, 92*g*, 92*i*, 92*j*, and 921 laterally meet. In other embodiments, the pointed shapes 92*e*, 92*h*, and 92*k* may be offset so that the apexes of the pointed shapes 92*e*, 92*h*, and 92*k* are not vertically aligned with a space where the other pointed shapes 92*a*, 92*c*, 92*d*, 92*f*, 92*g*, 92*i*, 92*j*, and 921 laterally meet. In one such embodiment, the pointed shapes 92*a* through 921 are arranged in vertical columns, such that the pointed shapes 92*b*, 92*e*, 92*h*, and 92*k* are not offset from the other pointed shapes 92*a*, 92*c*, 92*d*, 92*f*, 92*g*, 92*i*, 92*j*, and 921. In another embodiment, the pointed shapes 92*a* through 92*j* are arranged in columns, with some of the pointed shapes being vertically offset, for example as shown in FIG. 21.

Figure 12:
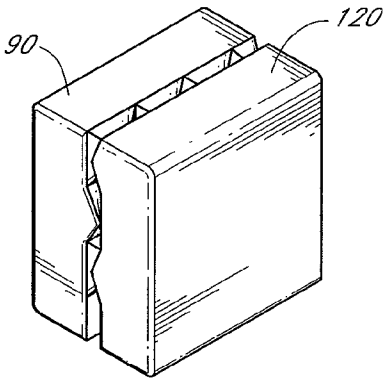
FIG. 12 is a perspective view of two of a second embodiment of an interlock structure, illustrated in FIG. 9, being pressed together.

FIG. 12 is a perspective view of the interlock structure 90 pressed together with a similar interlock structure 120. In this context, "similar" connotes that the interlock structure 120 comprises pointed shapes arranged in a series of lateral rows, wherein each row comprises a plurality of the pointed shapes. In the illustrated embodiment, the interlock structure 120 is substantially identical to the interlock structure 90. The use of substantially identical interlock structures may reduce manufacturing costs and concerns, and may allow the user greater flexibility when using or configuring the system 10. In another embodiment, the interlock structure 120 may comprise more or less pointed shapes, or more or less rows. Additionally, the pointed shapes may be positioned in a number of configurations, as described above, and may be configured to interact with a predetermined pattern of pointed shapes on the interlock structure 90. Those of skill in the art will understand the ways in which the pointed shapes may be positioned.

When the interlock structure 90 is pressed together, or registered, with the similar interlock structure 120 that is substantially identical to the interlock structure 90, as illustrated in FIG. 12, an offset of the pointed shapes 92*b*, 92*e*, 92*h*, and 92*k* ensures that at least one of the pointed shapes 92*b*, 92*e*, 92*h*, and 92*k* will be simultaneously located above, below and laterally between pointed shapes of the interlock structure 120. Thus, movement of the interlock structure 90 in any vertical or lateral direction will cause an upper surface, a lower surface, a first side surface, and/or a second side surface of the at least one pointed shape to contact a surface of a pointed shape of the interlocks structure 120. In this way, the interlock structure 90 can exert a force on the interlock structure 120 and movement of the interlock structure 90 in any vertical or lateral direction will cause corresponding movement of the interlock structure 120. Similarly, movement of the interlock structure 120 in a vertical or lateral direction will cause corresponding movement of the interlock structure 90.

Configuring the pointed shapes 92*e*, 92*h*, and 92*k* such that the apexes of the pointed shapes 92*e*, 92*h*, and 92*k* are vertically aligned with a space where the other pointed shapes 92*a*, 92*c*, 92*d*, 92*f*, 92*g*, 92*i*, 92*j*, and 92*l* laterally meet allows pointed shapes of the interlocks structures 90 and 120 that contact each other to contact each other along a maximum surface area. This increases the security of the connection between the interlocks structures 90 and 120.

When the pointed shapes 92*a* through 92*l* are vertically aligned in columns and the interlock structure 90 is pressed together, or registered, with the interlock structure 120, at least one of the pointed shapes 92*a* through 92*l* will be located above and below pointed shapes of the interlock structure 120, or the at least one pointed shape will be located laterally between pointed shapes of the interlock structure 120. The at least one pointed shape, however, will not be simultaneously located above, below and laterally between pointed shapes of the interlock structure 120. Therefore, when the pointed shapes 92*a* through 92*l* are vertically aligned in columns, only one of a vertical movement or a lateral movement of the interlock structure 90 will cause corresponding movement of the interlock structure 120. Similarly, only one of a vertical movement or a lateral movement of the interlock structure 120 will cause corresponding movement of the interlock structure 90.

Figure 13:
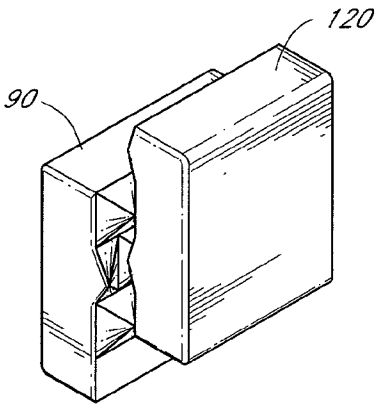
FIG. 13 is another perspective view of two of a second embodiment of an interlock structure, illustrated in FIG. 9, being pressed together.

As can be seen in FIG. 13, the interlock structure 90 and the interlock structure 120 can be pressed together, or register, in positions other than that illustrated in FIG. 12. The interlock structure 90 and the interlock structure 120 may be pressed together, or registered, in a plurality of vertical positions, similar to the plurality of vertical positions in which the interlock structure 70 and the interlock structure 170 of the first embodiment may be pressed together, described in reference to FIG. 8. The interlock structure 90 and the interlock structure 120 may also be pressed together, or registered in a plurality of lateral positions. While the interlock structure 70 and the interlock structure 170 may be pressed together in any number of lateral positions, the interlock structure 90 and the interlock structure 120 may only be laterally pressed together in registry in a discrete number of positions, as defined by the number of pointed shapes comprising each row of the interlock structure 90 and/or the interlock structure 120.

Figure 14:
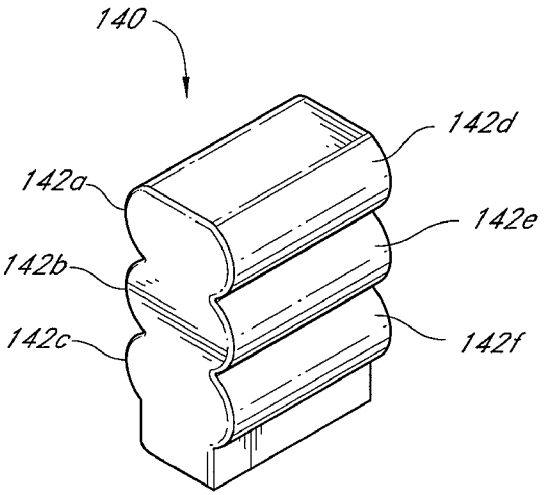
FIG. 14 is a perspective view of a third embodiment of an interlock structure of FIG. 1A.

FIG. 14 is a perspective view of a third embodiment of an interlock structure 140 of FIG. 1. The interlock structure 140 is comprised of rounded shapes 142*a* through 142*f*. The rounded shapes 142*a* through 142*f* are illustrated as being arranged in a series of rows. The rows are illustrated as being substantially lateral, but may be angled from a lateral direction. Although two sets of three rows of the rounded shapes 142*a* through 142*f* are illustrated, the interlock structure 140 may comprise additional rounded shapes, rows of rounded shapes, and/or sets of rounded shapes.

In the illustrated embodiment, the rounded shapes 142*a*, 142*b*, and 142*c* are located on a side of the interlock structure 140 opposing a side on which the rounded shapes 142*d*, 142*e*, and 142*f* are located. By locating the rounded shapes 142*a* through 142*f* in this way, a similar interlock structure can register with a plurality of sides of the interlock structure 140. In other embodiments, the rounded shapes 142*a*, 142*b*, and 142*c* may be located on a side of the interlock structure 140 other than, or in addition to, a side that opposes the side on which the interlock structures 142*d*, 142*e*, and 142*f* are located. Similarly, the interlock structures 70 and 90, illustrated in FIGS. 5 and 9, respectively, may have protrusions disposed on a plurality of sides.

The rounded shapes 142*a* through 142*f* are configured such that when the interlock structure 140 is raised or lowered, the rounded shapes 142*a* through 142*f* can apply a substantially vertical force. In the illustrated embodiment, the rounded shapes 142*a* through 142*f* extend laterally across the interlock structure 140. In another embodiment, the rounded shapes 142*a* through 142*f* may be arranged in a series of columns and may extend vertically across the interlock structure 140. In this embodiment, the rounded shapes 142*a* through 142*f* may be configured to apply a substantially lateral force when the interlock structure 140 is shifted laterally.

In the illustrated embodiment, the rounded shapes 142*a* through 142*f* are protrusions that are substantially semicircular. In another embodiment, the rounded shapes 142*a* through 142*f* may be more or less oblong. In yet another embodiment, the interlock structure 140 may comprise protrusions of differing shapes. For example, the rounded shapes 142*a*, 142*b*, and 142*c* may be substantially semicircular, while the rounded shapes 142*d*, 142*e*, and 142*f* may be more oblong. For further example, the interlock structure 140 may comprise the rounded shapes 142*a*, 142*b*, and 142*c* disposed on one side, and may further comprise pointed protrusions, such as illustrated in FIGS. 5and 9, disposed on another side. The pointed protrusions may be implemented in place of the rounded structures 142*d*, 142*e*, and 142*f*. Similarly, the interlock structures 70 and 90, illustrated in FIGS. 5 and 9, respectively, may have protrusions of differing shapes.

The interlock structure 140 may be pressed against, or registered with, a similar interlock structure in a plurality of vertical positions. In this context, a "similar interlock structure" connotes an interlock structure comprising rounded shapes arranged in a series of lateral rows. When the interlock structure 140 is pressed against the similar interlock structure, movement of the interlock structure 140 in a vertical direction will cause movement of the similar interlock structure in a vertical direction. Similarly, movement of the similar interlock structure in a vertical direction will cause movement of the interlock structure 140 in a vertical direction. This interaction of the interlock structure 140 and the similar interlock structure is similar to the interaction of the interlock structure 70 and the interlock structure 170, described in reference to FIGS. 7 and 8.

Figure 15:
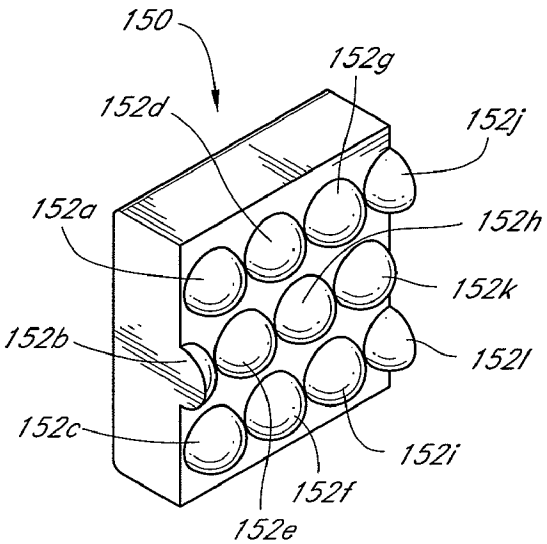
FIG. 15 is a perspective view of a fourth embodiment of an interlock structure of FIG. 1A.
Figure 16:
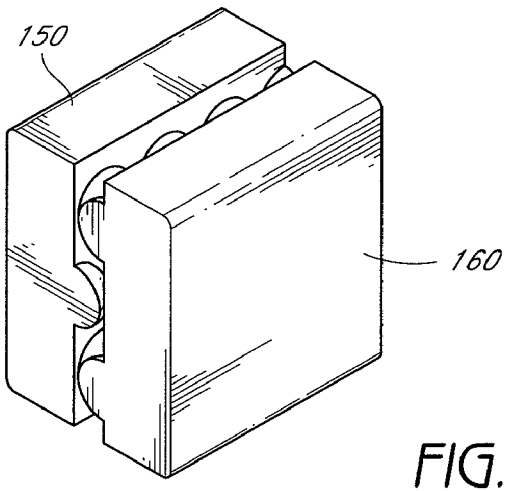
FIG. 16 is a perspective view of two of a fourth embodiment of an interlock structure, illustrated in FIG. 15, being pressed together.

FIG. 15 is a perspective view of a fourth embodiment of an interlock structure 150 of FIG. 1A. The interlock structure 150 is comprised of rounded shapes 152*a* through 152*j*. The rounded shapes 152*a* through 152*j* are illustrated as being arranged in a series of rows. The rows are illustrated as being substantially lateral, but may be angled from a lateral direction. Each row comprises a plurality of rounded shapes. Although the rows of the rounded shapes 152*a* through 152*l* are illustrated as comprising three or four rounded shapes, the rows may comprise fewer or additional rounded shapes. Additionally, although three rows of the rounded shapes 152*a* through 152*l* are illustrated, the interlock structure 150 may comprise additional rounded shapes and rows of rounded shapes. The rounded shapes 152*a* through 152*l* may be disposed on one or more sides of the interlock structure 150, as described above with reference to the interlock structure 140, illustrated in FIG. 14.

The rounded shapes 152*a* through 152*l* are configured such that that when the interlock structure 150 is moved in any vertical or lateral direction, the rounded shapes 152*a* through 152*l* can apply a vertical or lateral force. In the illustrated embodiment, the rounded shapes 152*a* through 152*l* are protrusions that are substantially hemispherical. In another embodiment, the rounded shapes 152*a* through 152*l* may be more or less oblong. In yet another embodiment, the interlock structure 150 may comprise protrusions of differing shapes.

The rounded shapes 152*a* through 152*l* may be arranged in a number of ways. For example, the rounded shapes 152*b*, 152*e*, 152*h*, and 152*k* may be arranged laterally offset from the other rounded shapes 152*a*, 152*c*, 152*d*, 152*f*, 152*g*, 152*i*, 152*j*, and 152*l*. In the illustrated embodiment, the rounded shapes 152*e*, 152*h*, and 152*k* are vertically aligned with a lateral space between the other rounded shapes 152*a*, 152*c*, 152*d*, 152*f*, 152*g*, 152*i*, 152*j*, and 152*l*. In addition, the rounded shapes 152*a* through 152*l* may be arranged in configurations similar to those configurations described in reference to the pointed shapes 92*a* through 92*l* of the interlock structure 90, as described in reference to FIG. 9.

The interlock structure 150 may be pressed against, or registered with, a similar interlock structure 160 in a plurality of vertical or lateral positions. In this context, a "similar interlock structure" connotes an interlock structure comprising rounded shapes arranged in a series of lateral rows, wherein each row comprises a plurality of rounded shapes. When the interlock structure 150 is pressed against the similar interlock structure 160, movement of the interlock structure 150 in a vertical and/or lateral direction will cause movement of the similar interlock structure 160 in a vertical and/or lateral direction, respectively. Similarly, movement of the similar interlock structure 160 in a vertical and/or lateral direction will cause movement of the interlock structure 150 in a vertical and/or lateral direction, respectively. This interaction of the interlock structure 150 and the similar interlock structure 160, and plurality of positions in which the interlock structure 150 and the similar interlock structure 160 may be pressed together or register, is similar to the interaction of the interlock structure 90 and the similar interlock structure 120 and the plurality of positions in which the interlock structure 90 and the similar interlock structure 120 may be pressed together, described in reference to FIGS. 12 and 13.

Embodiments of interlock structures complementary to the first through fourth embodiments of an interlock structure, illustrated in FIGS. 5, 9, 14, and 15, will now be described. In this context, a first interlock structure that is "complementary" to a second interlock structure connotes that at least a portion of the first interlock structure or the second interlock structure is an inverse of at least a portion of the other structure. Thus, if the second interlock structure comprises protrusions, at least a portion of the first interlock structure will comprise recesses that mirror the shape of the protrusions. Hence, when the first and second interlock structures are placed together, all surfaces of the protrusions will contact a surface of the second interlock structure.

Figure 17:
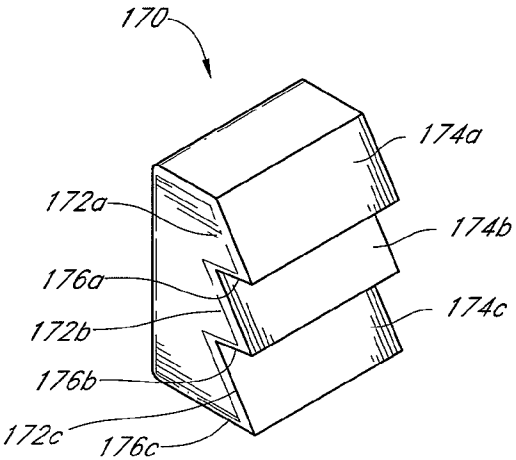
FIG. 17 is a perspective view of an embodiment of an interlock structure complementary to a first embodiment of an interlock structure, illustrated in FIG. 5.

FIG. 17 is a perspective view of an embodiment of an interlock structure 170 that is complementary to the first embodiment of an interlock structure 70, illustrated in FIG. 5. The interlock structure 170 is comprised of pointed shapes 172*a*, 172*b*, and 172*c* arranged in a series of rows. The rows are illustrated as being substantially lateral, but may be angled from a lateral direction. The interlock structure 170 may comprise more rows or pointed shapes than illustrated, and the pointed shapes 172*a*, 172*b*, and 172*c* may be disposed on one or more sides of the interlock structure 170, similar to the configuration of the interlock structure 70. The interlock structure 170 may comprise protrusions of differing shapes.

Each of the pointed shapes 172*a*, 172*b*, and 172*c* comprises an upper surface 174*a*, 174*b*, and 174*c*, respectively. Each of the pointed shapes 172*a*, 172*b*, and 172*c* also comprises a lower surface 176*a*, 176*b*, and 176*c*, respectively, configured such that when the interlock structure 170 is lowered, the lower surfaces 176*a*, 176*b*, and 176*c* can apply a substantially vertical force. As illustrated in FIG. 7, the interlock structure 170 may be pressed against the interlock structure 70 such that the upper surface 174*b* and lower surface 176*b* of the pointed shape 172*b* will be in complete contact (i.e. not separated by a substantial amount of space) with the lower surface 76*b* of pointed shape 72*b* and the upper surface 74*c* of the pointed shape 72*c* of the interlock structure 70. Other portions of the interlock structure 170 may also be in complete contact with the interlock structure 70 when pressed together in this position or in another position. Thus, at least a portion of the interlock structure 170 is an inverse of at least a portion of the interlock structure 70.

Figure 18:
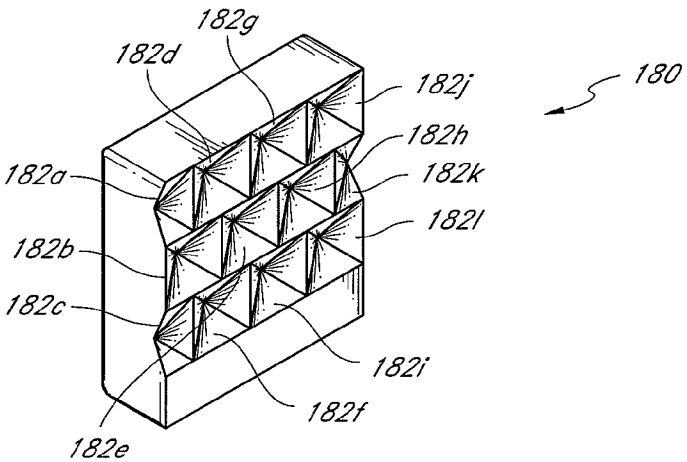
FIG. 18 is a perspective view of an embodiment of an interlock structure complementary to a second embodiment of an interlock structure, illustrated in FIG. 9.

FIG. 18 is a perspective view of an embodiment of an interlock structure 180 that is complementary to the second embodiment of an interlock structure 90, illustrated in FIG. 9. The interlock structure 180 is comprised of recesses 182*a* through 182*l* arranged in a series of rows. The rows are illustrated as being substantially lateral, but may be angled from a lateral direction. The interlock structure 180 may comprise more rows of recess and the recesses 182*a* through 182*l* may be disposed on one or more sides of the interlock structure 180, similar to the configuration of the pointed shapes 92*a* through 92*l* of the interlock structure 90. In the illustrated embodiment, the recesses 182*a* through 182*l* are shaped such that a pyramidal shape may be placed inside them. In another embodiment, the interlock structure 180 may comprise recesses of differing shapes, or may comprise a combination of recesses and protrusions. Similarly, the interlock structures 70, 90, 140, 150, and 170 may also comprise a combination of recesses and protrusions. In one embodiment, the interlock structure 180 comprises protrusions on one side and recesses on an opposing side.

In the illustrated embodiment, the recesses 1 82*a* through 182*l* are arranged in a series of three lateral rows, but the recesses 182*a* through 182*l* are not arranged in columns. The recesses 182*b*, 182*e*, 182*h*, and 182*k* are offset from the other recesses 182*a*, 182*c*, 182*d*, 182*f*, 182*g*, 182*i*, 182*j*, and 182*l*. Thus, a repeating pattern of recesses is formed.

The interlock structure 180 may be pressed against, or registered with, the interlock structure 90 in a plurality of positions. Those skilled in the art will appreciate that the recesses 182*a* through 182*l* of the interlock structure 180 may accept some or all of the pointed shapes 92*a* through 92*l* of the interlock structure 90. Thus, when the interlock structure 180 and the interlock structure 90 are pressed together or registered, a plurality of the pointed shapes 92*a* through 92*l* will be in complete contact with the surfaces of a plurality of the recesses 182*a* through 182*l*. Hence, at least a portion of the interlock structure 180 is an inverse of at least a portion of the interlock structure 90.

Figure 19:
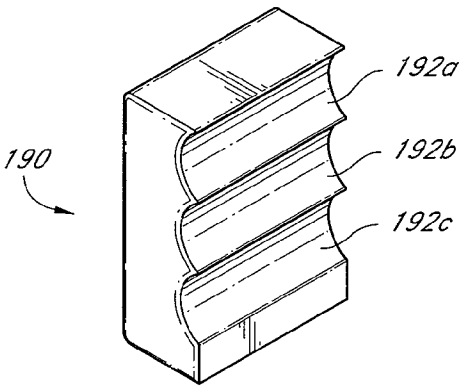
FIG. 19 is a perspective view of an embodiment of an interlock structure complementary to a third embodiment of an interlock structure, illustrated in FIG. 14.

FIG. 19 is a perspective view of an embodiment of an interlock structure 190 that is complementary to the third embodiment of an interlock structure 140, illustrated in FIG. 14. The interlock structure 190 is comprised of recesses 192*a*, 192*b*, and 192*c* arranged in a series of rows. The rows are illustrated as being substantially lateral, but may be angled from a lateral direction. The interlock structure 190 may comprise more rows of recess and the recesses may be 192*a*, 192*b*, and 192*c* may be disposed on one or more sides of the interlock structure 190, similar to the configuration of the rounded shapes 142*a*, 142*b*, and 142*c* of the interlock structure 140. In the illustrated embodiment, the recesses 192*a*, 192*b*, and 192*c* are shaped such that a semicircular shape may be placed inside them. In another embodiment, the interlock structure 190 may comprise recesses of differing shapes, or may comprise a combination of recesses and protrusions.

The interlock structure 190 may be pressed against, or registered with, the interlock structure 140 in a plurality of positions. Those skilled in the art will appreciate that the recesses 192*a*, 192*b*, and/or 192*c* of the interlock structure 190 may accept some or all of the rounded shapes 142*a*, 142*b*, and/or 142*c* of the interlock structure 140. Thus, when the interlock structure 190 and the interlock structure 140 are pressed together or registered, at least one of the rounded shapes 142*a*, 142*b*, and/or 142*c* will be in complete contact with at least one of the recesses 192*a*, 192*b*, or 192*c*. Hence, at least a portion of the interlock structure 190 is an inverse of at least a portion of the interlock structure 140.

Figure 20:
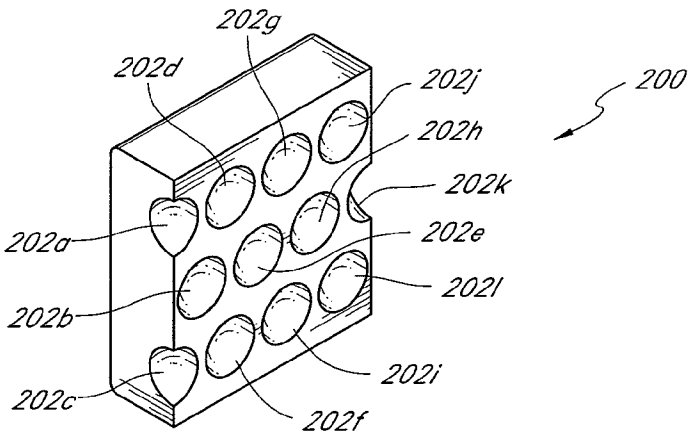
FIG. 20 is a perspective view of an embodiment of an interlock structure complementary to a fourth embodiment of an interlock structure, illustrated in FIG. 15.

FIG. 20 is a perspective view of an embodiment of an interlock structure 200 that is complementary to the fourth embodiment of an interlock structure 150, illustrated in FIG. 15. The interlock structure 200 is comprised of recesses 202*a* through 202*l* arranged in a series of rows. The rows are illustrated as being substantially lateral, but may be angled from a lateral direction. The interlock structure 200 may comprise more rows of recesses and the recesses 202*a* through 202*l* may be disposed on one or more sides of the I interlock structure 200, similar to the configuration of the rounded shapes 152*a* through 152*l* of the interlock structure 150. In the illustrated embodiment, the recesses 202*a* through 202*l* are shaped such that a hemispherical shape may be placed inside them. In another embodiment, the interlock structure 200 may comprise recesses of differing shapes, or may comprise a combination of recesses and protrusions.

In the illustrated embodiment, the recesses 202*a* through 202*l* are arranged in a series of three lateral rows, but the recesses 202*a* through 202*l* are not arranged in columns. The recesses 202*b*, 202*e*, 202*h*, and 202*k* are offset from the other recesses 202*a*, 202*c*, 202*d*, 202*f*, 202*g*, 202*i*, 202*j*, and 202*l*. Thus, a repeating pattern of recesses is formed.

The interlock structure 200 may be pressed against, or registered with, the interlock structure 150 in a plurality of positions. Those skilled in the art will appreciate that the recesses 202*a* through 202*l* of the interlock structure 200 may accept some or all of the rounded shapes 152*a* through-152*l* of the interlock structure 150. Thus, when the interlock structure 200 and the interlock structure 150 are pressed together or registered, a plurality of the rounded shapes 152*a* through 152*l* will be in complete contact with the surfaces of a plurality of the recesses 202*a* through 202*l*. Hence, at least a portion of the interlock structure 200 is an inverse of at least a portion of the interlock structure 150.

Those of skill in the art will appreciate that the system for attaching a shoe to a skateboard described above can arrest lateral and/or vertical movement of the shoe in relation to the skateboard. In addition, those of skill in the art will also appreciate that the interlocking structures of the system can be configured to allow a user wearing the shoe to move freely when the interlock structures are not engaged, while still providing the attachment of the shoe to the skateboard when necessary. To add to this, the interlocking structures may be pressed together in a plurality of vertical and/or lateral positions, providing adjustable and selectable attachment of the shoe to the skateboard.

Those of skill in the art will recognize that differing embodiments of the interlock structures may be pressed together to inhibit lateral and/or vertical movement of a shoe in relation to a skateboard. For example, the interlock structure 70 may be configured such that it may be pressed together with the interlock structure 90and/or the interlock structure 150. Also, the interlock structure 90 may be configured such that it may be pressed together with the interlock structure 170. In addition, the interlock structure 150 may be configured such that it may be pressed together with the interlock structure 140 and/or the interlock structure 190. Those of skill in the art will recognize that the illustrated embodiments of interlock structures may be pressed together, and thus engage or register, in ways other than those described to inhibit lateral and/or vertical movement of a shoe in relation to a skateboard, and those of skill in the art will recognize that other interlock structures may be pressed against the illustrated interlock structures to inhibit lateral and/or vertical movement of a shoe in relation to a skateboard.

Those of skill in the art will also recognize that the interlock structures may be configured to movement other than that described above. For example, where any interlock structure is configured to inhibit vertical movement with protrusions arranged in a series of rows, the interlock structure may also be configured to inhibit lateral movement by arranging the protrusions in a series of columns. In addition, the rows or columns can be angled with respect to a vertical and/or lateral direction to inhibit movement in a direction other than vertical or lateral.

While the above detailed description has shown, described, and pointed out novel features as applied to various aspects, it will be understood that various omissions, substitutions, and changes in the form and details of the system and structures illustrated may be made by those skilled in the art without departing from the scope of this disclosure. Although the description uses the term "skateboard" in many places, it will be understood that the system described herein can instead be used in any application in which it is desired to transiently attach a user's foot to a platform, so it is contemplated to substitute the word "platform" for the word "skateboard" throughout the foregoing. As will be recognized, the aspects and variations of the aspects may be embodied within a form that does not provide all of the features and benefits set forth herein, as some features may be used or practiced separately from others. The scope of this disclosure is defined by the appended claims, the foregoing description, or both. All changes which come within the meaning and range of equivalency of the claims are to be embraced within their scope.

What is claimed is:

1. A system for attaching a shoe to a skateboard, comprising:

a shoe comprising a first interlock structure on an outer portion of the shoe; and a skateboard having a top and a bottom and comprising a second interlock structure extending upward from the top of the skateboard, wherein the second interlock structure is configured to engage the first interlock structure so as to substantially prevent vertical movement, lateral movement, or both, of the shoe in relation to the skateboard when the first interlock structure is transversely pressed and maintained against the second interlock structure by transverse movement of the shoe by the user, wherein the first and second interlock structures are configured to disengage, when application of transverse pressure by the user is discontinued, wherein the first interlock structure and the second interlock structure can register in a plurality of lateral or a plurality of vertical positions, and wherein the first or second interlock structure comprises a plurality of protrusions.

2. The system of claim 1, wherein the plurality of protrusions are arranged in a plurality of rows.

3. The system of claim 2, wherein at least one row of the plurality of protrusions is offset from at least one other row of the plurality of protrusions.

4. The system of claim 1, wherein the plurality of protrusions are arranged in a plurality of columns.

5. The system of claim 4, wherein at least one column of the plurality of protrusions is offset from at least one other column of the plurality of protrusions.

6. The system of claim 1, wherein the protrusions of the first or second interlock structure comprise a plurality of substantially triangular shapes extending across the first or second interlock structure.

7. The system of claim 1, wherein the protrusions of the first or second interlock structure comprise a plurality of substantially pyramidal shapes.

8. The system of claim 1, wherein the protrusions of the first or second interlock structure comprise a plurality of substantially semicircular or semispherical shapes extending across the first or second interlock structure.

9. The system of claim 1, wherein the protrusions of the first or second interlock structure comprise a plurality of substantially hemispherical shapes.

10. The system of claim 1, wherein the second interlock structure is configured to substantially prevent both lateral and vertical movement of the shoe in relation to the skateboard when the first interlock structure is transversely pressed against the second interlock structure.

11. The system of claim 1, wherein the first and second interlock structures comprise a resilient polymer material.

12. The system of claim 1, wherein the plurality of protrusions are arranged in a vertically or laterally repeating pattern.

13. The system of claim 1, wherein the first and second interlock structures are substantially complementary.

14. The system of claim 1, wherein the skateboard further comprises a third interlock structure extending upward from the top of the skateboard, wherein the third interlock structure is configured to substantially prevent vertical or lateral movement of the shoe in relation to the skateboard when the first interlock structure is transversely pressed against the third interlock structure.

15. The system of claim 1, wherein the second interlock structure comprises a plurality of protrusions on at least two sides.

16. The system of claim 1, wherein the first or second interlock structure comprises a plurality of recesses.

17. A system for attaching a shoe to a skateboard, comprising:

a shoe comprising a first interlock structure on an outer portion of the shoe; and a skateboard having a top and a bottom and comprising a second interlock structure extending upward from the top of the skateboard, wherein the second interlock structure is configured to substantially prevent vertical movement, lateral movement, or both, of the shoe in relation to the skateboard when the first interlock structure is transversely pressed against the second interlock structure, wherein the first interlock structure and the second interlock structure can register in a plurality of lateral or a plurality of vertical positions, wherein the first interlock structure comprises a plurality of protrusions and the second interlock structure comprises a plurality of protrusions, and wherein both the plurality of protrusions of the first interlock structure and the plurality of protrusions of the second interlock structure are arranged in a plurality of rows or both the plurality of protrusions of the first interlock structure and the plurality of protrusions of the second interlock structure are arranged in a plurality of columns.

18. The system of claim 17, wherein the first and second interlock structures are substantially identical.

* * * * *